United States Patent [19]

Damrau

[11] Patent Number: 4,780,336

[45] Date of Patent: Oct. 25, 1988

[54] DOCTOR BLADE FOR PAPER COATER

[75] Inventor: Wayne A. Damrau, Wisconsin Rapids, Wis.

[73] Assignee: Consolidated Papers, Inc., Wisconsin Rapids, Wis.

[21] Appl. No.: 34,990

[22] Filed: Apr. 6, 1987

[51] Int. Cl.[4] ..... B05D 3/12; B05C 5/02

[52] U.S. Cl. ..... 427/356; 118/410; 118/413; 118/126

[58] Field of Search ..... 118/410, 413, 126; 427/356, 358

[56] References Cited

U.S. PATENT DOCUMENTS

| | | | |
|---|---|---|---|
| 4,133,917 | 1/1979 | Wallsten | 118/126 X |
| 4,250,211 | 2/1981 | Damrau et al. | 118/413 X |
| 4,405,661 | 9/1983 | Alheid | 118/413 X |

*Primary Examiner*—John P. McIntosh

*Attorney, Agent, or Firm*—Juettner Pyle Lloyd & Verbeck

[57] ABSTRACT

An improved doctor blade, for use at a downstream end of a pressurized coating material application zone of a paper coater, has a tip portion of a limited length and first thickness and a major body portion of a second and increased thickness. The increased thickness of the major body portion enables the doctor blade to resist flexure caused by variations in pressure of the coating material in the zone, so that the blade tip more uniformly meters and levels coating on a paper web. Also contemplated is an arrangement for clamping the blade at the downstream end of the application zone, in a manner to minimize flexure of the blade in response to variations in pressure of the coating material in the zone.

13 Claims, 1 Drawing Sheet

DOCTOR BLADE FOR PAPER COATER

BACKGROUND OF THE INVENTION

The present invention relates to doctor blades for paper coaters, and in particular to an improved doctor blade for use with a coater that applies liquid coating material to a paper web within a pressurized application zone.

Conventional coaters of the trailing blade type include means for applying liquid coating material to a paper web that is usually supported and carried by a resilient backing roll, together with a flexible doctor blade, located on the trailing side of the applicator, for metering and leveling the applied coating. In general, an excess of coating material is applied onto the web, and the doctor blade meters the excess while uniformly spreading the coating onto the web surface.

It has become desirable to produce papers having a minimum amount of coating. To achieve low coat weights with conventional trailing blade equipment, it is necessary to increase the pressure of the doctor blade against the web, but that results in a high rate of wear of the blade and necessitates frequent blade replacement. High blade pressure also increases the possibility of web breaks, as well as streaking caused by foreign particles caught between the blade and web.

Conventional coaters employ a relatively long dwell or soak time, which is the time interval between initial application and doctoring of the coating. As a result, the water portion of the coating composition, as well as some of the water soluble or dispersible materials contained in the composition, migrate into the moving web at a more rapid rate than the pigment, and eventually cause an undesirable imbalance in the coating constituents and their rheological properties. Long soak periods are also incompatible with the application of successive coats without intervening drying, because the successive coats tend to migrate into and contaminate the previous coat.

To overcome the disadvantages of prior applicators, and to apply lightweight coatings on paper, there has been developed a short dwell time applicator as disclosed in U.S. Pat. No. 4,250,211, issued to Damrau et al and assigned to the assignee of the present invention. In that applicator, coating material is introduced in excess into a relatively narrow application zone for being applied onto a web of paper carried through the zone. A forward wall of the applicator defines a relatively narrow gap with the web at the upstream end of the zone, and excess material in the zone overflows through the gap and forms therein a liquid seal, so that coating material in the zone and as applied onto the web is maintained under pressure. The speed of the web is adjusted for a relatively short dwell time, and a flexible doctor blade forms the downstream wall of the application zone and doctors the web at the downstream end of the zone, thereby removing excess material from and uniformly spreading the material on the web. In consequence of the short dwell time of the pressurized application of coating material onto the web, an appropriate yet lightweight amount of coating may be applied without need for high blade pressures.

A factor strongly influencing the quantity and uniformity of coating material applied onto a web, is the force and uniformity of the force with which the tip of the doctor blade is urged against the web. In short dwell time applicators, where the doctor blade forms the downstream wall of the application zone, coating liquid is against the blade and is very turbulent, especially at web travel speeds of 2500 fpm and higher. In consequence of the turbulence, there are variations in pressure of the coating liquid against the doctor blade, which cause the blade to flex and result in variations in the force with which the tip of the blade is urged against the web. Unfortunately, the variations in pressure of the coating liquid in the application zone, although small, are not controllable, and result in nonuniformities in the coating applied onto the web.

OBJECTS OF THE INVENTION

An object of the invention is to provide an improved doctor blade for a short dwell time paper coating applicator, that resists flexure from variations in pressure of coating liquid in an application zone of the applicator, so that the force of the blade tip against a paper web remains relatively constant for improved uniformity in the coating applied onto the web.

Another object is to provide an improved technique for mounting a doctor blade in a short dwell time applicator, to minimize flexure of the blade in response to variations in pressure of coating liquid in the application zone.

SUMMARY OF THE INVENTION

In accordance with one aspect of the invention there is provided, in combination, an apparatus for applying liquid coating material onto a paper web carried through a pressurized application zone, and an improved doctor blade for the apparatus. The apparatus comprises a front wall at a forward end of and extending transversely across the application zone and toward but spaced from the web to define a gap therewith, and means for supporting the doctor blade at a rearward end of the zone, so that the blade forms a rear wall of the zone and extends transversely across the zone and against the web for metering and leveling coating material on the web with a tip portion of the blade. The supporting means includes means for clamping the blade toward an end thereof opposite from the tip portion, and means for loading the blade toward the tip portion to urge the tip portion against the web, and means are provided for substantially sealing opposite side ends of the zone between the front wall and doctor blade. The apparatus also includes means for delivering liquid coating material under pressure and in sufficient quantity to the application zone to cause coating liquid under pressure to substantially continuously and completely fill the zone and the gap to form a liquid seal at the forward end of the zone, with the liquid seal maintaining the pressure of coating liquid in the zone so that coating liquid is applied onto the paper web under pressure as the web is carried through the zone. The coating liquid in the zone is relatively turbulent, and there are variations in pressure of the coating liquid against the doctor blade at the rearward end of the zone, that tend to cause flexure of the blade. To counteract the effect of the pressure variations on the doctor blade, the tip portion of the improved doctor blade has a limited length, in the direction perpendicular to the transverse extent of the blade, and a first thickness, and a remaining major body portion of the blade has a second and greater thickness. Because of the increased thickness of the doctor blade between the means for clamping and the means for loading, the blade has an increased resistance to flexure in response to variations in the pressure of coating liquid in the application zone, so that variations in the force of the blade tip against the web are minimized.

According to another aspect of the invention, the doctor blade may comprise either the improved or a conventional blade, the clamping means clamps the blade generally along a clamping line extending transversely of the blade, and the loading means loads the blade generally along a loading line extending transversely of the blade, intermediate the clamping line and blade tip, to urge the tip against the web. In this case, the ratio of the distance of the loading line to the from the blade tip distance of the clamping line from the loading line is on the order of 0.88 to 1.78, so that the unsupported area of the blade between the loading and clamping lines is relatively limited to minimize flexure of the blade in response to variations in pressure of coating material in the zone, thereby to minimize variations in the force of the blade tip against the web.

The foregoing and other objects, advantages and features of the invention will become apparent upon a consideration of the following detailed description, when taken in conjunction with the accompanying drawings.

DETAILED DESCRIPTION

Figure 1:
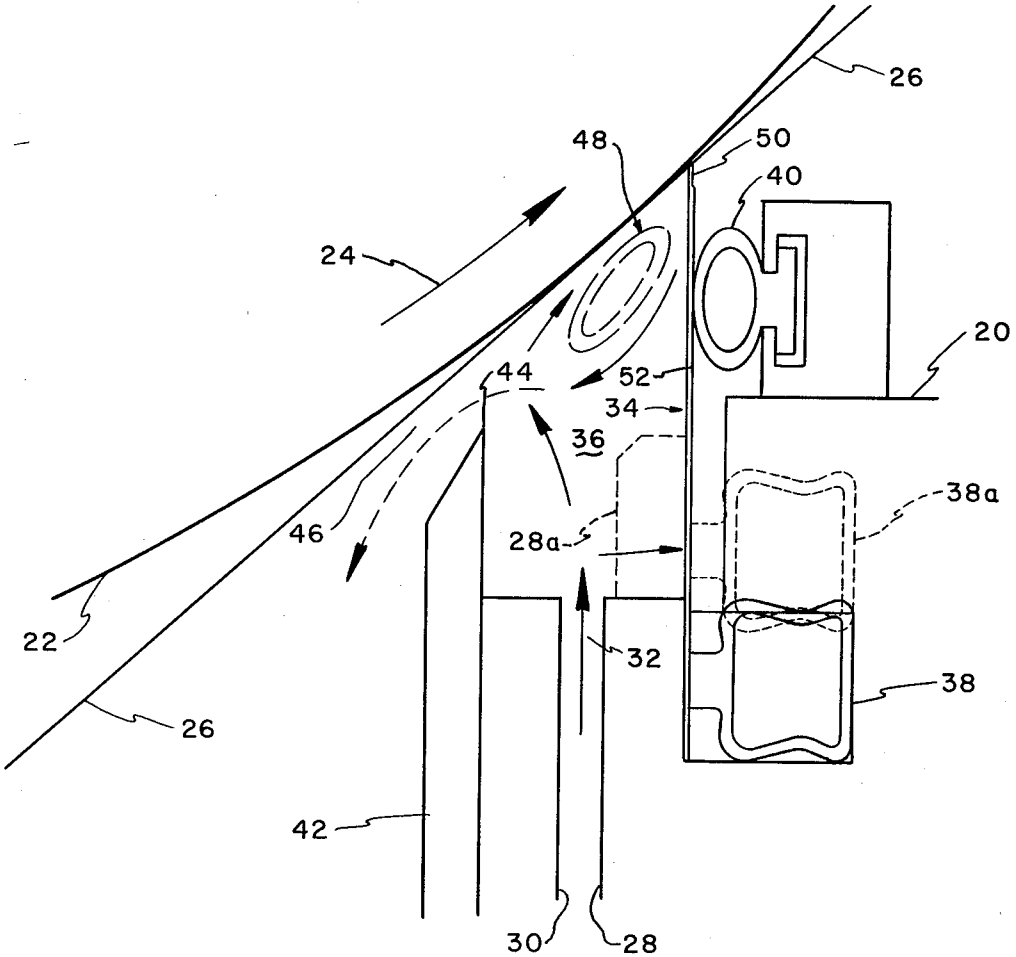
FIG. 1 is a side elevation view of a short dwell time applicator for applying liquid coating material onto a web of paper, showing an improved doctor blade, and an improved technique for clamping a doctor blade, at a downstream end of an application zone of the applicator.

FIG. 1 shows an applicator portion of a short dwell time paper coating machine, with which a doctor blade, configured according to the teachings of the invention, may advantageously be used. The applicator includes a main beam 20 extending parallel to and coextensively with a backing roll 22 that rotates in the direction shown by an arrow 24 and supports a web of paper 26 during its travel through an application zone. The beam has respective rear and front walls 28 and 30 that define a passage therebetween for reception of liquid coating material under pressure from a source of material (not shown), through which passage the material flows to a metering slot 32 that extends upwardly adjacent to and facing the web support surface of the roll 22.

A doctor blade 34 at a downstream end of an application zone 36 is held against a rearward surface of the wall 28 by a pneumatic tube 38 that is expandible by the introduction of fluid under pressure therein to press against the blade. The doctor blade extends beyond the metering slot 34, and its tip is urged into engagement with the web 26 on the roll 22 by a pneumatic tube 40, to meter and level the coating applied onto the web. An orifice plate 42 is vertically adjustable on the front wall 30, and extends toward the roll supported web. The orifice plate has a free edge 44 which is juxtaposed to but spaced slightly from the web, such that an orifice, gap or space 46 between the edge and web is relatively small and less than one inch.

At the two side ends of the coater, the spaces between the coater blade 34 and orifice plate 42 are sealed in a manner known in the art by flexible edge dams (not shown), which seal with the upper edges of the walls 28 and 30, the blade 34, the orifice plate 42 and the roll supported web 26, thereby to define the coating material application zone 36 downstream from the metering slot 32.

In operation of the applicator, coating liquid is introduced into the passage between the walls 28 and 30, under sufficient pressure and in sufficient quantity, to completely fill the metering slot 32 and application zone 36 defined by the doctor blade 34, orifice plate 42 and end dams, to cause a continuous, copious flow of coating material reversely of the direction of web travel through the narrow orifice 46. This forms a liquid seal in the orifice at the forward end of the application zone, and causes the coating liquid to be applied to the web in a very narrow transverse band under a positive pressure. The copious excess of coating liquid that flows through the orifice 46 reversely of the direction of web travel forms a nonabrasive liquid seal with the web at the upstream or forward edge of the coating application zone; causes the coating liquid in the zone to be maintained under pressure and to be applied to the web under pressure; seals off the forward edge of the zone against entry of air and foreign matter; strips air from the high speed web and prevents such air from causing streaks or skips in the coating on the web; and causes the downstream doctor blade 34 to doctor the coating liquid while the liquid is held under pressure.

The applicator is generally referred to as a short dwell time applicator. That is, to avoid saturation of the web with coating material, thereby to prevent the water portion of the coating composition as well as the water soluble or dispersible materials contained therein from migrating into the web at a more rapid rate than the pigment, the web is exposed to the coating material in the application zone 36 for only a relatively short time. To that end, the width of the application zone in the direction of web travel, as well as the speed of travel of the web through the zone, are controlled to provide a relatively short dwell time of the web within the zone. Generally, the speed of travel of the paper web through the zone is on the order of 2500–5000 fpm.

The coating applicator is of the type disclosed in detail in aforementioned U.S. Pat. No. 4,250,211, assigned to assignee of the present invention, and the teachings of which are specifically incorporated herein by reference. For a more specific description of the applicator, reference is made to said patent.

Conventionally, a doctor blade used in a short dwell time coater is on the order of 3.00" high and 0.015" thick, and forms the downstream end of the application zone 36. The lower end of the blade is clamped in place by the lower pneumatic tube 38, which engages the blade along a clamping line extending transversely of the blade. The blade tip is urged against the web by the upper pneumatic tube 40, which engages the blade below the tip and along a loading line extending transversely of the blade. In order to obtain a uniform layer of coating material on the surface of the paper web 26, the tip of the blade should be urged against the web with a substantially uniform force. However, as indicated at 48, coating liquid in the application zone is very turbulent, especially at web speeds on the order of 2500 fpm and higher. The turbulence causes pressure variations in the coating material in the zone, which are applied to the blade between the lower and upper pneumatic tubes 38 and 40, causing the blade to flex like a diaphragm between the tubes and, therefore, to pivot about the loading line where it contacts the upper tube 40. Outward or rearward flexure of the area of the blade between the tubes, due to increases in pressure of the coating material, increase the force of the blade tip against the web and decreases coat weight. On the other hand, decreases in pressure of coating material against the blade decrease the force of the blade tip against the web and increase coat weight. Consequently, the variations in pressure of the coating material cause nonuniformities in coat weight application on the web.

Figure 3:
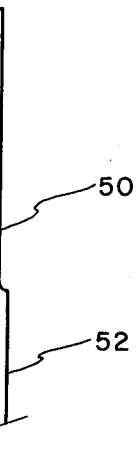
FIG. 3 is an enlarged, side elevation view of the tip portion of the blade.
Figure 2:
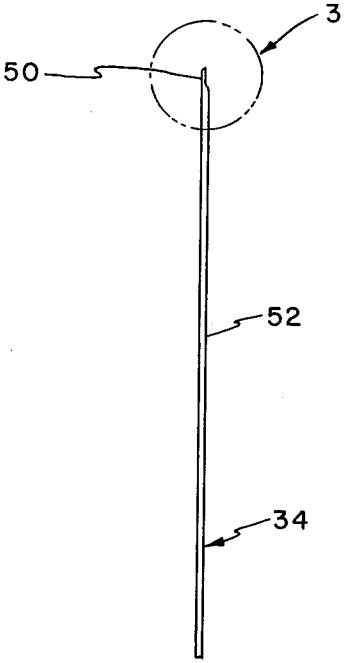
FIG. 2 is a side elevation view of the doctor blade.

The variations in pressure of the liquid coating material in the application zone 36 are not controllable. Therefore, to obtain a more uniform application of coating material on the web, according to one aspect of the invention the doctor blade 34 is configured to resist flexure in response to variations in pressure of the coating material. Similar to a conventional blade, the doctor blade 34 may be about 3.00" high. However, and with reference also to FIGS. 2 and 3, instead of having a uniform thickness of about 0.015" as is conventional, the blade has an operating tip portion 50 at its upper end that is on the order of 0.012"–0.018" thick, and a remaining major body portion 52 of increased thickness which, depending upon the thickness of the tip, may be from about 0.018"–0.025" thick. Generally, the difference in thickness between the tip and major body portions is on the order of 0.005"–0.010". The thickness of the operating tip is chosen so that it produces a desired coat weight range, with a thicker operating tip providing a higher coat weight, and a thinner operating tip a lower coat weight. For a given tip thickness, the increased thickness of the main body portion of the blade, between the pneumatic tubes 38 and 40, is better able to resist flexure from variations in coating material pressure within the application zone, so that the force of the blade tip against the web is more stable for improved uniformity in coat weight application. In one embodiment, which in testing provided improved uniformity in coat weight application, when viewed from the side the operating tip 50 was 0.180" long and 0.015" thick, while the remaining major body portion of the blade was 2.82" long and 0.022" thick.

According to another aspect of the invention, flexure of either a conventional doctor blade or the improved blade 34, in response to variations in pressure of coating material within the application zone 36, is reduced by decreasing the unsupported height of the blade between the lower and upper pneumatic tubes 38 and 40. This is accomplished by increasing the height of the applicator rear wall as shown at 28*a* in dashed lines, and elevating the lower pneumatic tube as shown at 38*a* in dashed lines. Conventionally, for a 3.00" high blade, the distance between the blade clamping and loading lines is on the order of 2.00". According to the invention, the lower clamping point is raised, so that the distance between the blade clamping and loading lines is reduced to about 0.56". This significantly reduces the unsupported height of the blade, so that flexure of the blade along the unsupported height, as a result of variations in pressure of coating material in the application zone, is reduced to minimize variations in the force with which the blade tip is urged against the web. While maintaining the unsupported height of the blade at about 0.56", the distance between the blade tip and the loading line may be varied from about 0.500"–1.00", to vary the ratio of the distance of the loading line from the end of the blade tip to the distance of the clamping line from the loading line from about 0.88 to 1.78, to control the application of low to high coat weights, respectively, on the web. If desired, or if necessary to obtain a small spacing between the clamping and loading lines, the lower pneumatic tube 38 may be replaced with a mechanical clamp.

While embodiments of the invention have been described in detail, various modifications and other embodiments thereof may be devised by one skilled in the art without departing from the spirit and scope of the invention, as defined in the appended claims.

What is claimed is:

1. In combination, an apparatus for applying liquid coating material onto a surface of a paper web carried through a pressurized application zone at a speed of at least 2500 fpm, and an improved doctor blade for said apparatus, said apparatus comprising a front wall at a forward end of and extending transversely across said application zone and toward but spaced from the web to define a gap therewith; means for supporting said doctor blade at a rearward end of said application zone, so that said doctor blade forms a rear wall of said zone and extends transversely across said zone and toward and against the web for metering and leveling coating material on the web with a tip portion of said doctor blade, said supporting means including means for clamping said blade toward an end opposite from said tip portion and means for loading said blade toward but not at said tip portion to urge said tip portion against the surface of the web; means for substantially sealing opposite side ends of said application zone between said front wall and doctor blade; and means for delivering liquid coating material under pressure and in sufficient quantity to said application zone to cause coating liquid under pressure to substantially continuously and completely fill said zone and said gap to form a liquid seal in said gap at said forward end of said zone, the liquid seal maintaining the pressure of coating liquid in said zone so that coating liquid is applied onto the paper web under pressure as the web is carried through said zone, wherein the coating liquid in said zone is relatively turbulent and there are variations in pressure of the coating liquid against said doctor blade at said rearward end of said zone, and wherein said improved doctor blade is characterized in that said tip portion is of limited length, in the direction perpendicular to the transverse extent of said blade, and has a first thickness on the order of 0.012" to 0.018", and a remaining major body portion of said doctor blade has a second and greater thickness on the order of 0.005" to 0.010" thicker than said tip portion, and said clamping and loading means engage said major body portion so that said doctor blade, between said means for clamping and said means for loading, has an increased resistance to flexure in response to variations in pressure of coating liquid thereagainst, whereby variations in the force of said tip portion against the web are minimized.

2. The combination as in claim 1, wherein said doctor blade tip and major body portions have an overall length of about 3.00", and said doctor blade tip portion has a length of about 0.180".

3. The combination as in claim 2, wherein said doctor blade tip portion has a thickness of about 0.015" and said major body portion a thickness of about 0.022".

4. The combination as in claim 1, wherein said doctor blade tip and major body portions have an overall length of about 3.00", said loading means loads said blade generally along a loading line extending transversely of said blade and adjustably positionable between about 0.500" to 1.00" from the end of said tip portion, and said clamping means clamps said blade generally along a clamping line extending transversely of said blade and maintained spaced about 0.56" from said loading line on the side of said loading line away from said tip portion, so that the ratio of the distance of said loading line from the end of said tip portion to the distance of said clamping line from said loading line is on the order of 0.88 to 1.78 to control the application of low to high coat weights, respectively, on the web and so that the unsupported area of said blade between said loading and clamping lines is relatively limited to minimize flexure of said blade in response to variations in pressure of coating material in said application zone, thereby to minimize variations in the force of said blade tip against the web.

5. The combination as in claim 1, wherein said clamping means clamps said blade generally along a clamping line extending transversely of said blade, said loading means loads said blade generally along a loading line extending transversely of said blade intermediate said clamping line and tip portion, and the ratio of the distance of said loading line from the end of said tip portion of the distance of said clamping line from said loading line is on the order of 0.88 to 1.78.

6. An improved apparatus for applying liquid coating material under pressure onto a surface of a paper web carried through a pressurized application zone, said apparatus comprising a front wall at a forward end of and extending transversely across said application zone and toward but spaced from the web to define a gap therewith; a doctor blade at a rearward end of said application zone and forming a rear wall of and extending transversely across said zone and toward and against the web of metering and leveling coating material on the web with a tip of said blade; means for supporting said doctor blade at said rearward end of said application zone, said means for supporting including means for clamping said blade generally along a clamping line extending transversely of said blade and spaced from said tip, and means for loading said blade generally along a loading line extending transversely of said blade intermediate said clamping line and tip to urge said tip against the web; means for substantially sealing opposite side ends of said application zone between said front wall and doctor blade; and means for delivering liquid coating material under pressure and in sufficient quantity to said application zone to cause coating liquid under pressure to substantially continuously and completely fill said zone and said gap to form a liquid seal in said gap at said forward end of said zone, said liquid seal maintaining the pressure of coating liquid in said zone so that coating liquid is applied onto the web under pressure as the web is carried through said zone, whereby the coating liquid in said zone is relatively turbulent and there are variations in pressure of the coating liquid against said doctor blade at said rearward end of said zone, and wherein the improvement is characterized in that said doctor blade has a length of about 3.00" in the direction perpendicular to the transverse extent of said blade, said clamping line is maintained spaced about 0.56" from said loading line on the side of said loading line away from said tip, and said loading line is positionable between about 0.500" to 1.00" from the point of contact of said blade tip with the web to vary the ratio of the distance of said loading line from the point of contact of said doctor blade tip with the web to the distance of said clamping line from said loading line from about 0.88 to 1.78 to control the application of low to high coat weights, respectively, on the web and so that the unsupported area of said blade between said loading and clamping lines is relatively limited to minimize flexure of said blade in response to variations in pressure of the coating material in said zone, and thereby to minimize variations in the force of said blade tip against the web.

7. An improved apparatus as in claim 6, wherein said doctor blade has a tip portion of limited length and of a first thickness and a remaining major body portion of a greater length and greater thickness, and said loading line is along said major body portion, whereby the increased thickness of said major body portion further minimizes flexure of said blade in response to variations in pressure of the coating material in said application zone, and thereby further minimizes variations in the force of said blade tip against the web.

8. An improved apparatus as in claim 7, wherein the difference in thickness between said doctor blade tip and major body portions is on the order of 0.005" to 0.010".

9. An improved apparatus as in claim 7, wherein said doctor blade tip portion has a thickness on the order of 0.012" to 0.018", and said major body portion has a thickness on the order of 0.018" to 0.025", but is thicker than said tip portion.

10. An improved apparatus as in claim 7, wherein said doctor blade tip portion has a length on the order of 0.180".

11. An improved apparatus as in claim 10, wherein said doctor blade tip portion has a thickness of about 0.015" and said major body portion a thickness of about 0.022".

12. An improved method of applying liquid coating material under pressure onto a surface of a paper web carried through a pressurized coating material application zone, wherein the application zone is defined between a front wall at a forward end of and extending transversely across the zone and toward but spaced from the web to define a gap therewith, a doctor blade at a rearward end of the zone and forming a rear wall of and extending transversely across the zone and toward and against the web with a tip of the blade, and seals at opposite side ends of the zone for substantially sealing the side ends, said method comprising the steps of delivering liquid coating material under pressure and in sufficient quantity to the application zone to cause coating liquid under pressure to substantially continuously and completely fill the zone and the gap to form a liquid seal in the gap at the forward end of the zone, the liquid seal maintaining the pressure of coating liquid in the zone so that coating liquid is applied onto the web under pressure as the web is carried through the zone; clamping the doctor blade generally along a clamping line extending transversely of the blade and spaced from the blade tip; and loading the doctor blade along a loading line extending transversely of the blade intermediate the clamping line and tip to urge the tip against the web to meter and level the coating liquid on the web at the rearward end of the zone, wherein the coating liquid in the zone is relatively turbulent and there are variations in pressure of the coating liquid against the doctor blade at the rearward end of the zone that cause variations in the force of the blade tip against the web, and wherein the improvement is characterized in that said blade clamping and loading steps are controlled so that the distance between the clamping and loading lines is maintained constant while the distance of the loading line from the blade tip is varied so that the ratio of the distance of the loading line from the blade tip to the distance of the clamping line from the loading line is varied from between about 0.88 to 1.78 to control the application of low to high coat weights, respectively, onto the web and so that the unsupported area of the blade between the loading and clamping lines is relatively limited to minimize flexure of the blade in response to variations in pressure of the coating liquid against the blade, thereby to minimize variations in the force of the blade tip against the web.

13. A method as in claim 12, wherein the doctor blade has a length of about 3.00" in the direction perpendicular to the transverse extent of the blade, and said blade clamping and loading steps are controlled to position the loading line from about 0.500" to 1.00" from the blade tip in accordance with desired coat weight while the clamping line is maintained at a distance of about 0.56" from the loading line.

* * * * *